US006413151B2

(12) United States Patent
Mizuno et al.

(10) Patent No.: US 6,413,151 B2
(45) Date of Patent: Jul. 2, 2002

(54) CMP SLURRY RECYCLING APPARATUS AND METHOD FOR RECYCLING CMP SLURRY

(75) Inventors: Hiroshi Mizuno, Gresham, OR (US); Masaaki Ogitsu, Tsukuba (JP); Takuya Nagamine, Shimotsuma (JP); Toru Kikuchi, Sekijyou-machi (JP)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 09/730,704

(22) Filed: Dec. 6, 2000

(30) Foreign Application Priority Data

Dec. 10, 1999 (JP) ..... 11-351216

(51) Int. Cl.[7] ..... B24B 7/19

(52) U.S. Cl. ..... 451/41; 451/36; 451/285; 451/287; 451/453

(58) Field of Search ..... 451/41, 285, 287, 451/288, 59, 63, 36, 453, 60, 446

(56) References Cited

U.S. PATENT DOCUMENTS

| | | | | | |
|---|---|---|---|---|---|
| 5,755,614 | A | * | 5/1998 | Adams et al. | 451/60 |
| 5,975,991 | A | * | 11/1999 | Karlsrud | 451/41 |
| 6,056,631 | A | * | 5/2000 | Brown et al. | 451/288 |
| 6,106,662 | A | * | 8/2000 | Bibby, Jr. et al. | 156/345 |
| 6,152,806 | A | * | 11/2000 | Nystrom | 451/36 |
| 6,183,352 | B1 | * | 2/2001 | Kurisawa | 451/87 |

* cited by examiner

*Primary Examiner*—Eileen P. Morgan
(74) *Attorney, Agent, or Firm*—Luedeka, Neely & Graham

(57) ABSTRACT

A polishing table 11 in the CMP apparatus 10 has a diameter smaller than the diameter of a polishing pad 12. The polishing pad 12 is disposed on the polishing table so as to cover the entire top surface of the polishing table 11. A space 13 is formed between outside of the outer peripheral surface of the polishing table 11 and under the outer peripheral bottom surface portion of the polishing pad 12 projecting outside from the edge of the polishing table 11. A trough 14 with an opening 14*a* on top thereof as a device for withdrawing the used slurry is disposed around the outer peripheral surface of the polishing table 11 so as to be located a part thereof in the space 13.

17 Claims, 2 Drawing Sheets

CM P SLURRY RECYCLING APPARATUS AND METHOD FOR RECYCLING CMP SLURRY

FIELD OF THE INVENTION

The present invention relates to a chemical-mechanical polishing (CMP) slurry recycling apparatus for recycling a CMP slurry and a method for recycling a CMP slurry, which are adapted to enable a decrease in costs incurred in chemically-mechanically polishing semiconductor wafers and other objects by repetitive use of a CMP slurry.

BACKGROUND OF THE INVENTION

A CMP process is used in planarizing the surfaces of wafers, substrates and other objects before subjecting e.g. semiconductor wafers to exposure processing. The CMP process is a polishing process that combines a chemical reaction by a solute in a slurry as a polishing fluid and a mechanical polishing action produced by a polishing pad and abrasive particles in the slurry.

In conventional CMP processes, a slurry is not reused and is discarded. As polishing slurry is expensive, discarding it after a single use contributes to the expense of producing semi-conductor wafers.

The slurry is collected in a storage tank, and then discarded. Collection of used slurry is effected by means of a collecting trough disposed so as to enclose an outer peripheral surface of a polishing table and a bottom portion thereof. The slurry supplied to the polishing pad is allowed to flow from the polishing pad along the outer peripheral surface of the polishing table and the bottom portion thereof into the collecting trough, and the slurry flown into the collecting trough is then transferred to the storage tank for withdrawal of the slurry. In such a conventional polishing process, the used slurry comes into contact with a wide area of the outer peripheral surface and the bottom surface of the polishing table before it is collected in the collecting trough. This extensive contact of the used slurry with the polishing table gives rise to a risk of a portion of the slurry sticking to and becoming solid on the outer peripheral surface of the polishing table or the bottom surface when the slurry is flown from the polishing pad to the collecting trough. Further, there is a risk of the slurry scattering from the rotating polishing table and not reaching the collection trough. Attempts have so far been made to recycle and reuse slurry deposited in a storage tank. It has been found necessary, however, for fresh slurry to be supplemented in a large amount in order to efficiently reuse the slurry once used, because efficiency of collecting the used slurry is very low.

SUMMARY OF THE INVENTION

Therefore, the present invention has the object to provide a CMP slurry recycling apparatus and a method for recycling a CMP slurry once used, which enables costs in a planarizing process for planarizing the surfaces of semiconductor wafers and other objects to be reduced by reusing and recycling the used CMP slurry in an efficient way.

In order to achieve the object in one aspect, the present invention provides a CMP slurry recycling apparatus for recycling a CMN slurry, in which the slurry is supplied to a polishing pad disposed on a polishing table to polish the polishing object, while the used slurry is withdrawn from the polishing pad, wherein the polishing table is arranged such that a diameter thereof is set to be smaller relative to the diameter of the polishing pad and wherein a collecting device having an opening on top thereof is disposed around the outer peripheral surface of the polishing table so as to withdraw the slurry directly from the polishing pad in the device.

With the arrangement of the apparatus as described above, the CMP slurry recycling apparatus according to the present invention can increase efficiency in withdrawing the used CMP slurry by directly collecting or withdrawing the used slurry from the polishing pad because it can prevent the used slurry from sticking and becoming solid on the surfaces of the polishing table and from scattering from the polishing pad.

In a preferred embodiment of the present invention, the device is composed of a trough in a U-shaped transverse section and disposed around the outer periphery of the polishing table so as for a top end at an inner edge side of the trough to be located in a slightly spaced relationship below the outer peripheral bottom edge portion of the polishing pad.

In order to achieve the object in another aspect, the present invention provides the CMP slurry recycling method for recycling a CMP slurry, in which the slurry is supplied to a polishing pad disposed on a polishing table to polish the polishing object, while the used slurry is withdrawn from the polishing pad, the method comprising the steps of: setting a diameter of the polishing table to be smaller than a diameter of the polishing pad; arranging a generally U-shaped device having an opening on top thereof around the outer peripheral surface of the polishing table so as for a top edge of the device at the inner edge side thereof to be located under the outer peripheral bottom surface portion of the polishing pad; withdrawing the used slurry in the device directly from the peripheral edge of the polishing pad through the opening; transferring the used slurry withdrawn by the device to a storage tank after filtering to remove contaminants; and supplying the slurry from the storage tank to the polishing pad disposed on the polishing table after further filtering to remove contaminants.

Other objects, features and advantages of the present invention will become apparent in the course of the following description with reference to the accompanying drawings.

DESCRIPTION OF THE PREFERRED EMBODIMENTS

The chemical-mechanical polishing (CMP) slurry recycling apparatus according to the present invention will be described in more detail with reference to the accompanying drawings.

Figure 1:
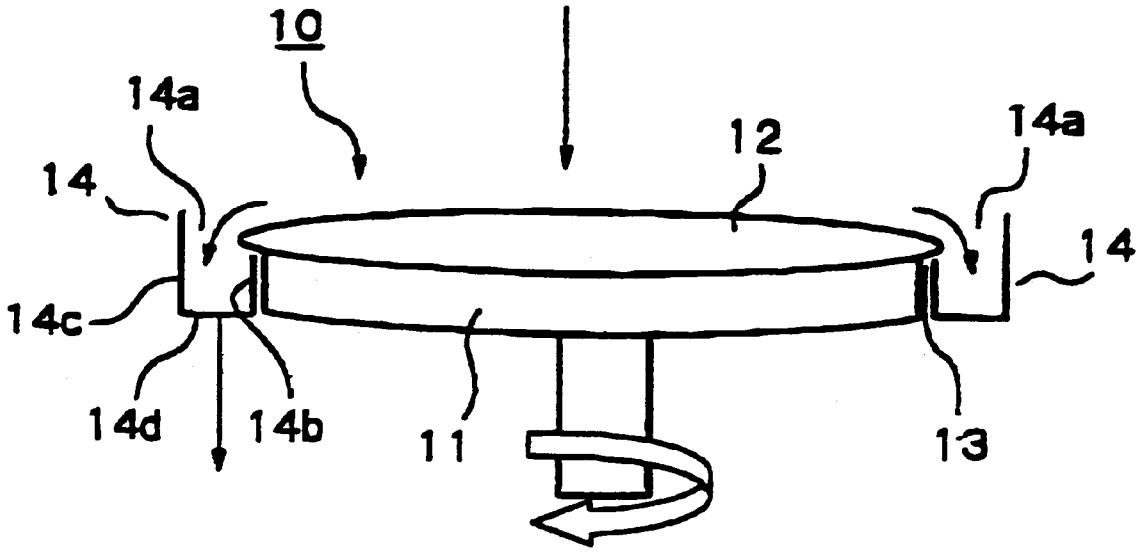
FIG. 1 is a schematic representation of a CMP slurry recycling apparatus which incorporates the features of the present invention therein (note that the trough of the slurry collecting device is shown in cross section for clarity of description)
Figure 2:
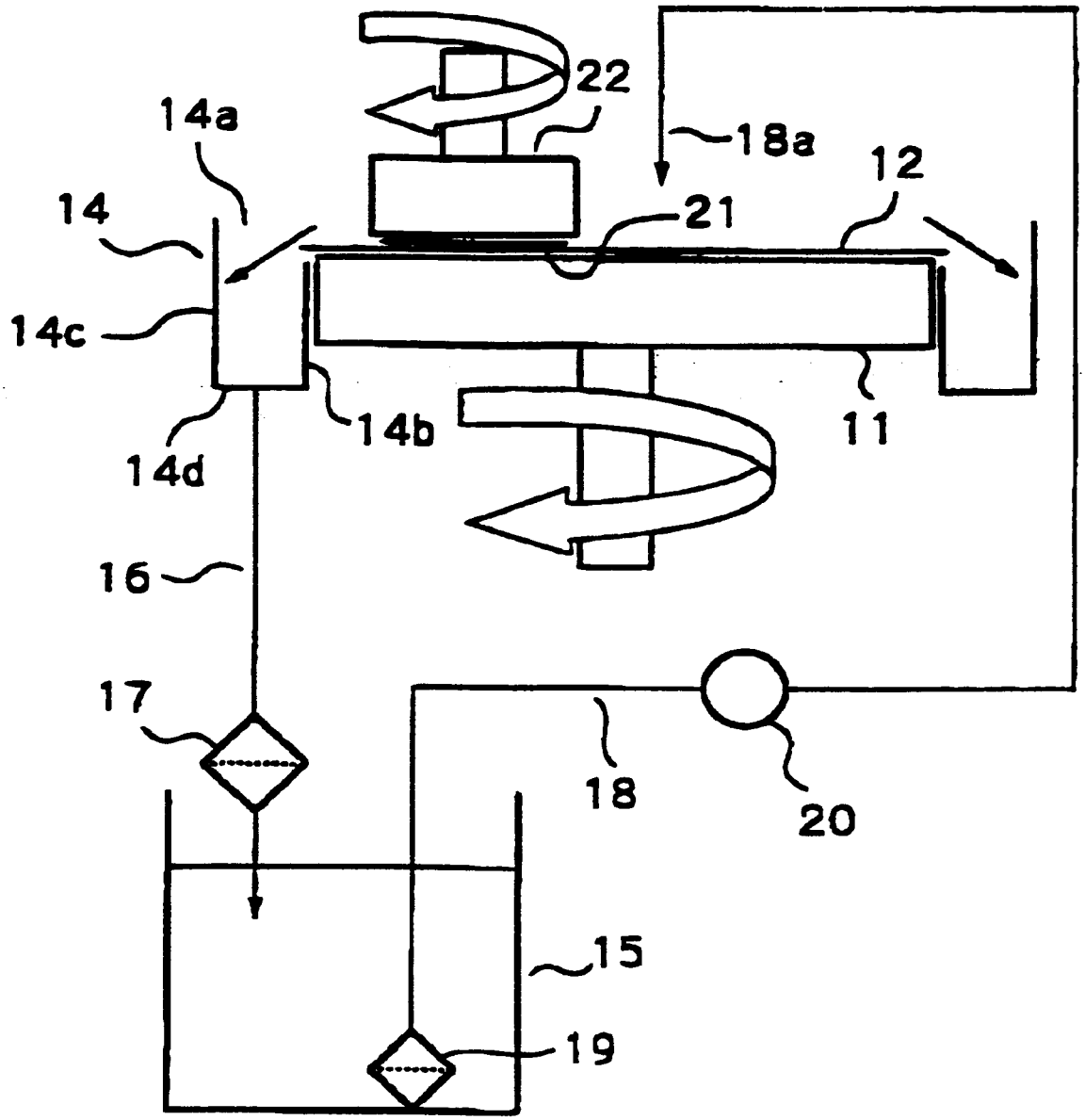
FIG. 2 is a schematic representation of a CMP slurry recycling apparatus similar to FIG. 1, but also showing additional components such as a circulating pump and a storage tank.

A description will be given regarding an embodiment of the CMP slurry recycling apparatus of the present invention. As shown in FIGS. 1 and 2, a polishing table 11 in a disk form in a CMN apparatus 10 has a diameter which is smaller than that of a polishing pad 12 in a disk form. The polishing pad 12 is disposed on the polishing table 11 so as to cover the entire surface thereof. The outer peripheral edge portion of the polishing pad 12 projects outside from the peripheral edge of the polishing table 11 by the difference of the diameter between the polishing table 11 and the polishing pad 12. The area outside and around the outer peripheral surface of the polishing table 11 and under the projecting bottom surface portion of the polishing pad 12 is referred to herein as a space 13. In other words, the space 13 is located outside the outer periphery of the polishing table 11 and under the bottom surface portion of the polishing pad 12 projecting outside the outermost edge of the polishing table 11. A collecting device is disposed around the outer periphery of the polishing table 11 so as to have an inner side portion thereof located in the space 13.

The collecting device may be composed of a trough 14 of a ring-shaped form in a plane cross section and of a U-shaped form in a transverse section. The trough 14 comprises an opening 14*a* on top thereof, an inner side wall 14*b*, an outer side wall 14*c*, and a bottom face 14*d*. The inner side wall 14*b* is located in the space 13. The outer side wall 14*c* is located out side of the space 13 and arranged along the inner side wall 14*b* and the polishing table 11. The bottom of the outer side wall 14*c* is connected to the bottom of the inner side wall 14*b* via the bottom face 14*d* to form a U-shaped recipient portion in which the used slurry is flown from the edge of the polishing pad 12 and collected or withdrawn.

More specifically, a top of the inner side wall 14*b*, that is, a top of inner edge of the opening 14*a* of the trough 14 is located slightly under the outer bottom edge portion of the polishing pad 12 in order for the used slurry to fall directly into the U-shaped recipient portion of the trough 14 from the outermost edge of the polishing pad 12. On the other hand, the outer side wall 14*c* of the trough 14 is arranged to be higher than the inner side wall 14*b* thereof and the horizontal top surface level of the polishing pad 12 so as for the used slurry to fail to scatter off the trough 14.

With the arrangement of the trough 14, the slurry fed to the top surface of the polishing object disposed on the polishing pad 12 is allowed to flow on the top surface outward and then directly into the trough 14 via the inner side wall 14*b* without flowing along the outer surface of the polishing table 11. Furthermore, the used slurry can be received by the outer side wall 14*c* of the trough 14, even if it would scatter from the polishing pad 12 due to the centrifugal force produced by rotation of the polishing pad.

Moreover, the inner surface of the U-shaped collecting trough 14 is surface-treated so as to become smooth enough for the used slurry to flow smoothly and to fail to stick to the surface thereof and become solid thereon.

A circulating pipe 16 is disposed in the bottom face 14*d* of the trough 14 connecting to a storage tank 15 for temporarily storing the used slurry in order to allow recycling it by feeding it to the polishing pad 12. The slurry used is withdrawn in the trough 14 and then transferred via the circulating pipe 16 to the storage tank 15. The circulating pipe 16 is provided with a trap filter 17 at an appropriate position thereof so as to remove foreign materials such as polishing chips and so on contaminated in the slurry during the polishing process.

Between the storage tank 15 and the polishing table 11 is also disposed a circulating pipe 18 to allow the storage tank 15 to feed the used slurry stored therein to the polishing pad 12 for recycling. At one end of the circulating pipe 18 that is located in the storage tank 15 is provided a final filter 19 for further removal of contaminants such as polishing chips and so on, and a circulating pump 20 is disposed at an appropriate position of the circulating pipe 18. The other end of the circulating pipe 18 extends toward the polishing table 11 and is located above the polishing pad 12. This configuration of the circulating pipe 18 allows the used slurry stored in the storage tank 15 to be pumped up by means of the circulating pump 20 while further removing the contaminants contained therein by the final filter 19, and to be fed to the opposite side of the circulating pipe 18. The used slurry pumped up by the pump 20 is then supplied onto the top surface of the polishing pad 12 from the supply section 18*a* of the pipe 18.

Above the polishing table 11 is disposed a polishing head 22 that can press a semiconductor wafer 21 as a polishing object against the top surface of the polishing pad 12 at a predetermined level of force. The polishing head 22 is set to have a diameter somewhat larger than that of the semiconductor wafer 21. Further, the polishing head 22 is driven by a drive unit (not shown) so as to rotate in the same direction as the polishing table 11 and can be transferred in the radial direction of the polishing table 11 to polish the semiconductor wafer 21 uniformly over the entire surface area thereof. This arrangement of the polishing head 22 can avoid an occurrence of the irregular and local polishing on the surface of the semiconductor wafer 21.

The polishing table 11 may comprise, for example, a metallic platen in the disk shape and may have a diameter ranging from 48 cm to 57 cm. The polishing table 11 is rotated by a drive unit (not shown) to polish a polishing object by means of the polishing pad 12 disposed on the top surface thereof. On the other hand, the polishing pad 12 may be made, for example, of a polyurethane material or a non-woven cloth and have a diameter ranging from 53 cm to 61 cm. In order to place the polishing pad 12 on the top surface of the polishing table 11, the polishing pad 12 is selected and used which may have a diameter larger by approximately 4 cm to 6 cm than the diameter of the polishing table 11.

The slurry may be in the form of a suspension containing abrasive particles, for example, of silica, alumina, or any other appropriate abrasive material in a liquid, e.g., water adjusted to an appropriate pH level. Although the flow rate of the slurry to be supplied may be varied with the kind of the polishing objects, it may range typically from approximately 1,000 ml to 1,500 ml per minute. On the other hand, in conventional techniques, the flow rate of a slurry may be in the range of approximately 175 ml to 200 ml per minute, much smaller than in the case of the present invention. In the conventional techniques, the slurry is discarded after use for polishing, and not reused by recycling. Therefore, the flow rate of the slurry to be supplied was limited to as low a range as possible in order to avoid an increase in manufacturing costs.

For operating the CMP slurry recycling method of this invention, the semiconductor wafer 21 is first placed with its polishing surface down on the polishing pad 12 and it is pressed from top by the polishing head 22 at a predetermined amount of pressure. Then, the circulating pump 20 is operated to transfer the slurry from the storage tank 15 to the supply section 18*a* of the circulating pipe 18 and then supply the slurry to the polishing pad 12 from the supply section 18*a* of the circulating pipe 18. The polishing table 11 and the polishing head 22 are rotated to polish the polishing surface of the semiconductor wafer 21 at a predetermined amount over its entire surface area.

The slurry supplied to the polishing pad 12 penetrates into an interface between the polishing surface of the semiconductor wafer 21 and the top surface of the polishing pad 12 and chemically and mechanically polish the polishing surface of the semiconductor wafer 21 with the aid of the CMP slurry. The used slurry is then allowed to flow out from the interface between the semiconductor wafer 21 and the polishing pad 12 and flow on and along the top surface of the polishing pad 12 in the radial direction toward the outside of the polishing pad, followed by falling down from the outermost peripheral edge of the polishing pad 12 directly into the trough 14. Upon the used slurry dropping from the polishing pad 12, it is guided on and along the inner wall surface of the inner side wall 14*b* of the trough 14, thereby preventing the used slurry from falling down on and along the outer peripheral surface and the bottom surface of the polishing table 11 and allowing the used slurry to be collected directly in the trough 14. Moreover, the outer side wall 14*c* of the trough 14 can prevent the used slurry from scattering off the trough 14 as the slurry scatters away from the peripheral edge of the polishing pad 12 due to the centrifugal force rendered by the rotation of the polishing pad 12. The arrangement of the trough 14 in association with the polishing table 11 and the polishing pad 12 can collect the slurry used for the CMP process directly in the trough 14 without falling outside the trough 14.

The slurry withdrawn in the trough 14 is then transferred to the storage tank 15 via the circulating pipe 16. Before feeding the used slurry into the storage tank 15, the slurry is subjected to filtering through the trap filter 17 to remove polishing chips and other contaminants contained therein. Upon feeding the slurry stored in the storage tank 15 to the polishing pad 12, the slurry is again subjected to filtering by means of the final filter 19 in order to further remove contaminants therein. After filtering with the final filter 19, the slurry is supplied to the polishing pad 12 from the supply section 18*a* of the circulating pipe 18. The supply of the slurry from the storage tank 15 to the polishing pad 12 via the circulating pipe 18 is continued during the CMP process.

The slurry may be adjusted to an appropriate pH and replenished with water etc., upon supplying to the storage tank 15 or to the circulating pipe 18. A chemical for reproduction use or a fresh slurry may be added as needed. The temperature of the slurry may be adjusted with a heat exchanger.

The CMP slurry recycling method according to the above embodiment of the present invention can collect or withdraw the used slurry without causing sticking on the outer peripheral surface and the bottom surface of the polishing table 11 and scattering outside the polishing pad 12, so that the efficiency of collecting the slurry can be increased to a remarkable extent. Furthermore, the CMP slurry recycling method according to the present invention can dramatically save the amount of a fresh slurry to be supplemented, rendering a substantially large amount of cost savings for the process of planarizing the semiconductor wafer 21.

The repetitive recycling of the used slurry enables the slurry to be used at a larger flow rate than in conventional CMP process and therefore can accomplish substantial improvements in the polishing quality while reducing manufacturing costs, because the used slurry is recycled. This can substantially reduce the frequency of occurrences of defects on the surface of semiconductor wafers during the polishing process.

As described above, the present invention provides the CMP slurry recycling apparatus and method for recycling the used CMP slurry, wherein the diameter of the polishing table is set to be smaller than that of the polishing pad and the collecting device with an opening on top is disposed slightly apart from and around the outer periphery of the polishing table to allow a direct collection of the used slurry from the polishing pad into the collecting device. The arrangement of the collecting device in association with the polishing table and the polishing pad can improve efficiency of collecting or withdrawing the used slurry because this can prevent the used slurry from sticking and becoming solid on the surface of the polishing table as well as dropping and scattering off outside the collecting device. This reduces costs of planarizing and manufacturing semiconductor wafers and other objects.

Having described the present invention in the manner as described above, it has to be understood that the present invention is not limited in any respect to the above embodiment and the above embodiment is described for illustrative purposes. It is further apparent that the present invention encompasses a variety of modifications and variations without departing from the scope and spirit of the invention.

What is claimed is:

1. An arrangement for polishing a semiconductor wafer with (i) a polishing pad having a first diameter and (ii) a slurry disposed on said polishing pad, comprising:

a polishing table having a surface configured to receive said polishing pad, said polishing table having a second diameter which is less than said first diameter of said polishing pad so that when said polishing pad is positioned on said surface a peripheral edge of said polishing pad extends outwardly beyond a peripheral side wall of said polishing table; and a ring shaped trough defined by an inner side wall, an outer side wall and a bottom wall connecting the inner side wall and the outer side wall, wherein the outer side wall has a first length and the inner side wall has a second length, said inner side wall of said trough being disposed adjacent said peripheral side wall of said polishing table whereby said outer side wall of said trough extends above said surface of said polishing table, so that when said polishing pad is positioned on said surface of said polishing table, and said polishing table and said polishing pad are rotated, said slurry is advanced from said polishing pad into said trough.

2. The arrangement of claim 1, further comprising:

a storage tank in fluid communication with said trough such that slurry advanced into said trough is further advanced into said storage tank.

3. The arrangement of claim 2, further comprising:

a pump in fluid communication with said storage tank, wherein actuation of said pump withdraws slurry from said storage tank.

4. The arrangement of claim 3, further comprising:

a pipe in fluid communication with said storage tank and said pump, said pipe having a supply section which is positioned relative to said polishing table so that when said polishing pad is positioned on said surface of said polishing table and said pump is actuated, said slurry is advanced through said supply section and disposed on said polishing pad.

5. The arrangement of claim 1, further comprising:

a polishing head configured to receive said semi conductor wafer, said polishing head being positioned in an opposing relationship relative to said surface of said polishing table.

6. The arrangement of claim 1, wherein:

said trough has a substantially "U" shaped transverse cross section defined by said inner side wall, said outer side wall and said bottom wall.

7. The arrangement of claim 1, wherein:

said first length is greater than said second length.

8. An apparatus for chemically-mechanically polishing a semiconductor wafer, comprising:

a polishing table having a first diameter;

a polishing pad positioned on a surface of said polishing table, said polishing pad having a second diameter which is larger than said first diameter so that a peripheral edge of said polishing pad extends outwardly beyond a peripheral side wall of said polishing table;

a slurry disposed on said polishing pad;

a polishing head configured to receive said semiconductor wafer, said polishing head being positioned in an opposing relationship relative to said surface of said polishing table; and a ring shaped trough defined by an inner side wall, an outer side wall and a bottom wall connecting the inner side wall and the outer side wall, wherein the outer side wall has a first length and the inner side wall has a second length, said inner side wall of said trough being disposed adjacent said peripheral side wall of said polishing table whereby said outer side wall of said trough extends above said surface of said polishing table, so that when said polishing table and said polishing pad are rotated, said slurry is advanced from said polishing pad into said trough.

9. The apparatus of claim 8, further comprising:

a storage tank in fluid communication with said trough such that slurry advanced into said trough is further advanced into said storage tank.

10. The apparatus of claim 9, further comprising:

a pump in fluid communication with said storage tank, wherein actuation of said pump withdraws slurry from said storage tank.

11. The apparatus of claim 10, further comprising:

a pipe in fluid communication with said storage tank and said pump, said pipe having a supply section which is positioned relative to said polishing table so that when said polishing pad is positioned on said surface of said polishing table and said pump is actuated, said slurry is advanced through said supply section and disposed on said polishing pad.

12. The apparatus of claim 8, wherein:

said trough has a substantially "U" shaped transverse cross section defined by said inner side wall, said outer side wall and said bottom wall.

13. The apparatus of claim 8, wherein:

said first length is greater than said second length.

14. A method of polishing a semiconductor wafer, comprising:

(a) securing a polishing pad having a first diameter to a surface of a polishing table having a second diameter which is less than said first diameter so that a peripheral edge of said polishing pad extends outwardly beyond a peripheral side wall of said polishing table;

(b) disposing a slurry onto said polishing pad; and (c) rotating said polishing pad so that said slurry is advanced from said polishing pad into a ring shaped trough defined by an inner side wall, an outer side wall and a bottom wall connecting the inner side wall and the outer side wall, wherein the outer side wall has a first length and the inner side wall has a second length, said inner side wall of said trough being disposed adjacent said peripheral side wall of said polishing table whereby said outer side wall of said trough extends above said surface of said polishing table.

15. The method of claim 14, further comprising:

(d) advancing said slurry from said trough into a storage tank.

16. The method of claim 15, further comprising:

(e) advancing said slurry from said storage tank back onto said polishing pad during (c).

17. The method of claim 14, wherein:

said first length is greater than said second length.

* * * * *